US006438928B1

(12) United States Patent
Huang et al.

(10) Patent No.: US 6,438,928 B1
(45) Date of Patent: Aug. 27, 2002

(54) MACHINE FOR AUTOMATED BOXING OF SOFT STACKED ITEMS

(75) Inventors: Daniel C. Huang; Frank F. J. Huang, both of Tustin; Frank Pannier, Irvine, all of CA (US)

(73) Assignee: Supertonics, LLC, Tustin, CA (US)

( * ) Notice: Subject to any disclaimer, the term of this patent is extended or adjusted under 35 U.S.C. 154(b) by 0 days.

(21) Appl. No.: 09/738,489

(22) Filed: Dec. 15, 2000

(51) Int. Cl.[7] ..... B65B 5/06
(52) U.S. Cl. ..... 53/473; 53/249
(58) Field of Search ..... 53/249, 250, 255, 53/256, 260, 384.1, 570, 473; 414/268

(56) References Cited

U.S. PATENT DOCUMENTS

| | | | | | |
|---|---|---|---|---|---|
| 3,678,649 | A | * | 7/1972 | Clancy | 53/124 |
| 3,846,959 | A | | 11/1974 | Good | 53/61 |
| 4,048,784 | A | | 9/1977 | Toby | 53/77 |
| 4,398,383 | A | | 8/1983 | Prakken | 53/537 |
| 4,583,351 | A | | 4/1986 | Fallas | 53/501 |
| 4,660,352 | A | | 4/1987 | Deines et al. | 53/438 |
| 4,768,328 | A | | 9/1988 | Mims | 53/532 |
| 4,776,148 | A | | 10/1988 | Mingozzi | 53/143 |
| 4,781,011 | A | * | 11/1988 | Prakken | 53/537 |
| 4,864,801 | A | | 9/1989 | Fallas | 53/446 |
| 4,942,720 | A | | 7/1990 | Berney | 53/447 |
| 5,263,302 | A | | 11/1993 | Hauers et al. | 53/544 |
| 5,535,576 | A | * | 7/1996 | Walintschek | 53/501 |
| 5,675,963 | A | * | 10/1997 | Nicholson et al. | 53/540 |

* cited by examiner

*Primary Examiner*—Scott A. Smith
*Assistant Examiner*—Chukwurah Nathaniel
(74) *Attorney, Agent, or Firm*—Christie, Parker & Hale, LLP

(57) ABSTRACT

A device for use in boxing pliable objects having a footprint into boxes. The boxing device includes a trapdoor unit, a box conveying unit, a tamping unit, and a control unit. The trapdoor unit has coplanar sliding trays that are adapted to be rapidly and simultaneously moved apart from a horizontal closed position, wherein the trays are close together with each, to a horizontal opened position, wherein the trays are slid apart by a distance sufficiently large to pass the footprint of the plurality of objects and permit the objects to fall therethrough in a flat manner into open boxes below. The box conveying unit moves empty open boxes to a position underneath the trapdoor unit. The tamping unit has tamping plates which tamps the objects into the box, and the control unit which controls the operation of the trapdoor unit, the box conveying unit, and the tamping unit.

64 Claims, 7 Drawing Sheets

FIG. 3
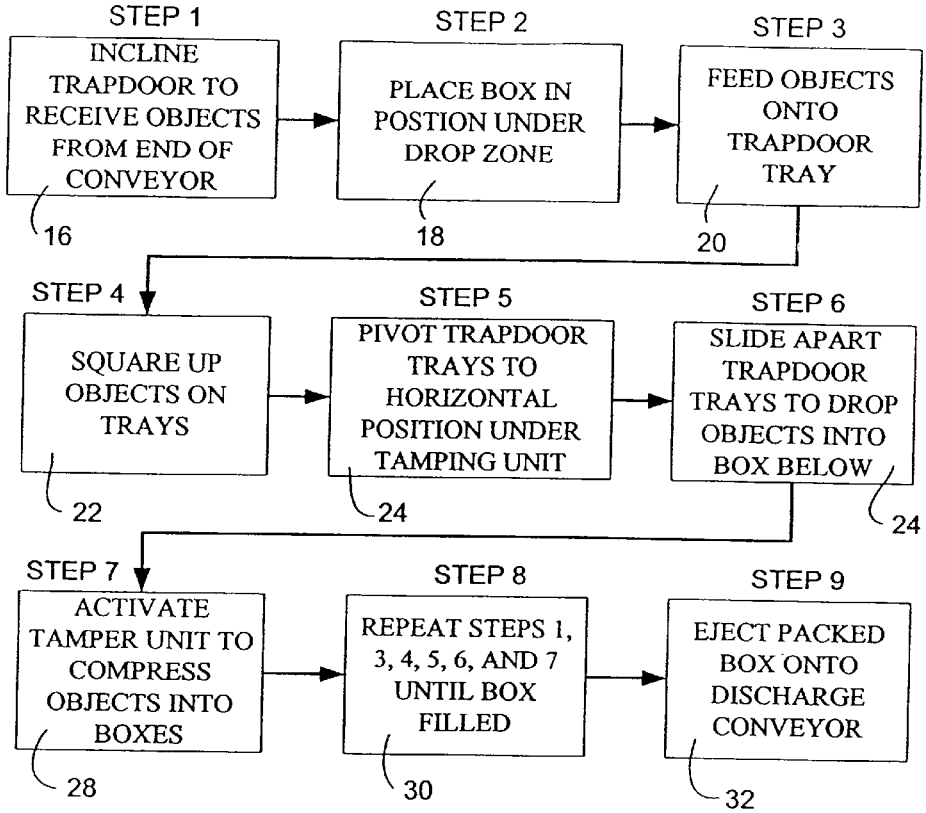
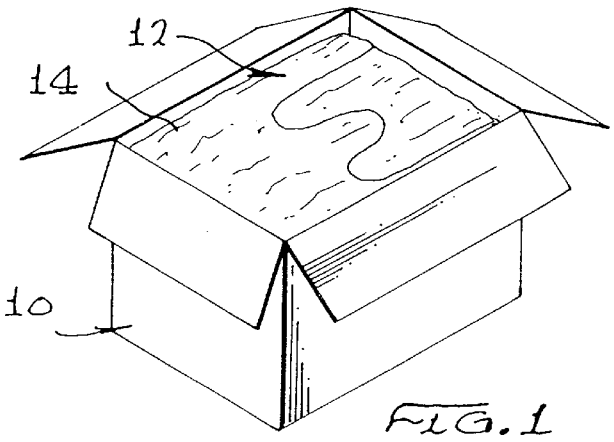
FIG. 1
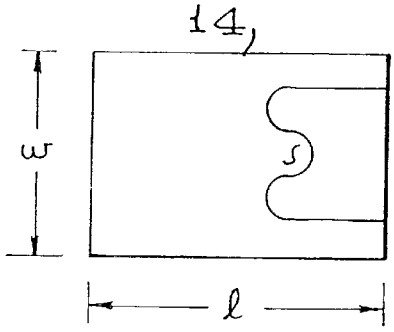
FIG. 2

STEP 1

STEPS 2 AND 3

STEPS 4 AND 5

STEP 6

STEPS 8 AND 9

MACHINE FOR AUTOMATED BOXING OF SOFT STACKED ITEMS

FIELD OF THE INVENTION

This invention relates to boxing machines, and more particularly to machines for the automated boxing of soft stacked items, such as with packs of loose plastic bags and the like.

BACKGROUND OF THE INVENTION

While many aspects of manufacturing and packaging have been automated, one area that still requires a considerable amount of human labor is the loading of boxes with soft and flexible goods, such as packs of plastic bags. Unlike the packing of discretely sized, relatively incompressible, and/or individually packaged objects into boxes, soft goods, such as stacked of plastic bags and the like are not easy to load into boxes since they tend to be shift around. Therefore, presently workers must box these items by hand. This boxing represents a significant labor expense.

In the process of manufacturing packs of plastic bags, such as packs of T-shirt bags and merchandise bags are created with many individual bags held together loosely in alignment. The bags in the pack can shift if not handled carefully.

The process of manufacturing T-shirt and merchandise bags involves providing tubular plastic film material. For seamless side edge bags, a continuous tubular plastic film is provided. Likewise, larger diameter tubular material can be formed into multiple tubes by forming side seams. For bags with gussets, a gusseting station folds sides of the plastic material inwardly at two sides. The tubular plastic film is then cut and seemed at bottom and optionally top ends to form closed bottom bags. For T-shirt bags, a top edge of the bag is sealed to form "pillowcases". The individual bags are then stacked in alignment, and further die cutting of the stacked bags is carried out to form the bag packs. The individual bags are held together in alignment by frangible pressure bonds, by adhesive spots, by hot welds, and the like. After the packs of bags are formed, then a number of packs are placed into boxes. This process is presently carried out by hand labor, with one worker typically manning a single bag manufacturing line. After the boxes are loaded, they are closed, and are loaded onto pallets. This process is highly labor intensive and adds significantly to the overall manufacturing costs.

There according remains a need for an automated boxing device for deformable goods, such as packs of bags and the like.

SUMMARY OF THE INVENTION

The invention provides a boxing device for packaging pliable objects having a length and width into boxes and for use in combination with a conveyor device upon which the objects to be boxed are placed.

The invention further provides an automated boxing device for packaging multiple packs of pliable packs of plastic bags having a footprint area into cardboard boxes that ensures that the plastic bag packs are properly placed therein.

The invention also provides a boxing device for packaging pliable objects having a length and width into boxes and for use in combination with a conveyor device upon which the objects to be boxed are placed, the boxing device having a trapdoor unit, a box conveying unit, a tramping unit, and a control unit.

The invention yet further provides a boxing device for packaging pliable objects having a length and width into boxes, cartons, and other containers without need for a conveyor device.

The yet further provides an automated method of boxing pliable objects having a footprint area into a box.

BRIEF DESCRIPTION OF THE DRAWINGS

FIG. 1 is a perspective view of a plurality of objects loaded into a box.

FIG. 2 is a top plan view of an item to be loaded into the boxes.

FIG. 3 is a flowchart illustrating the steps undertaken by the device to load a plurality of objects into a box.

FIG. 4 is a left front perspective view showing the boxing device of the invention and the conveyor with objects placed thereon.

DETAILED DESCRIPTION OF THE INVENTION

Figure 9:
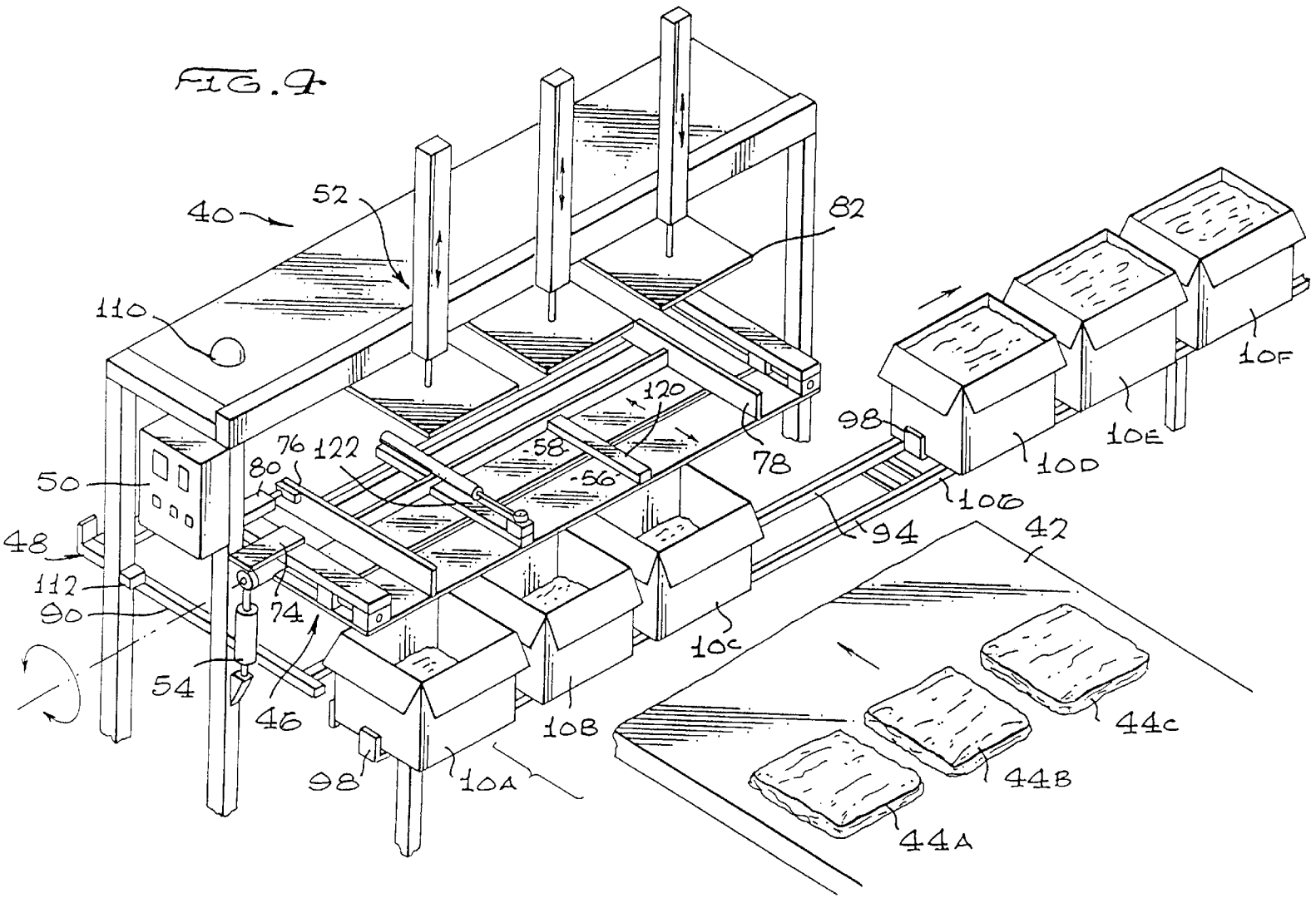
FIG. 9 is a side view of the boxing device of FIG. 8, with the sliding plates separated to allow the object to drop into an open box.

The boxing device comprises the following main functional units, as follows: a moveable trapdoor unit, a box conveying unit, and a control unit that controls the operation of the moveable trapdoor unit and the box conveying unit. Optionally, a tramping unit is also provided.

While the invention was developed with stacked plastic bags in mind, it can be used to box a wide variety of items, and is particularly useful for boxing flexible items that would otherwise need to be hand loaded into boxes. For purposes of the discussion of the invention, reference may be made to plastic bag packs, but again, the invention can be used to load any number of types of items into boxes.

Turning to FIG. 1, there is a shown a top plan view of a box 10 with an open top 12 with an item 14 shown placed therein. (In fact, a plurality of items 14, e.g. multiple plastic bag packs, are shown stacked in box 10. Plastic bag packs 14 are shown in FIG. 2, and have a length "L" and a width "W", which define a footprint area, and the dimensions of item 14 is such that items 14 can be placed in a lay flat position through open top 12 of box 10. While a stack of plastic bags 14 is shown, the object can comprise any object, and as noted above, the invention is particularly useful for use in packing pliable objects into boxes and cartons.

FIG. 3 is a flowchart showing the steps taken to load objects into boxes. In step 1 (16), trapdoors trays are inclined to receive object from an end of a conveyor. In step 2 (18),boxes are placed under a drop zone of the trapdoors trays. In step 3 (20), the objects are fed onto the trapdoor trays. In step 4 (22), the objects are squared up on the trapdoor trays. In step 5 (24), the trapdoor trays are pivoted to a horizontal position under a tamping unit. In step 6 (26), the trapdoor trays are slide apart to drop objects into a box below. In step 7, the tamper unit is activated to compress objects into the box. Depending upon the number and characteristics of the objects to be placed into the box, step 7 may not need to be carried out each time an object is dropped into the box. In step 8, steps 1, 3–7 are repeated until the box is filled. In step 9, the box packed with objects is ejected onto a discharge conveyor, and the process may begin anew with the placement of an empty box under the drop zone.

Figure 5A:
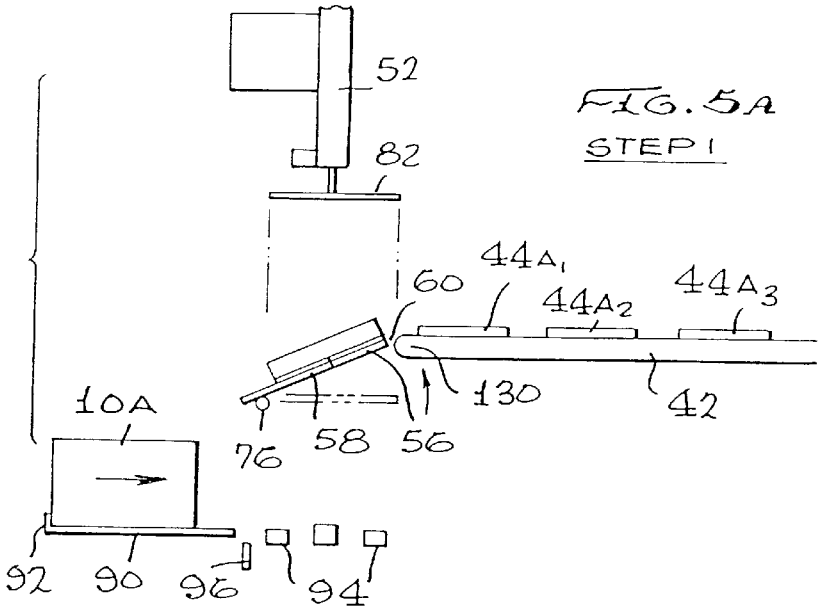
FIG. 5A is a side view illustrating operation of step 1 of FIG. 2 of the operation of the boxing device.

FIG. 4 is a left front perspective view showing the boxing device 40 placed at an end of a conveyor 42 of the invention and the conveyor with objects 44 placed on conveyor 42 thereon. The packaging device 40 has a trapdoor unit 46, a box conveying unit 48, a control unit 50, and a tamping unit 52. The device 40 is shown in an embodiment adapted to box three separate lines of objects 44A, 44B, and 44C, which are to be loaded into three boxes 10A, 10B, and 10C, respectively, but the device can have a single lines, or any number of separate lines of objects to be boxed. The trapdoor unit 46 has means 54 to raise sliding trays 56 and 58 from a generally horizontal orientation, as shown in FIG. 4, to a position that its slanted downwardly from front tray 56 to rear tray 58 (as is shown in FIG. 5A.) The means to raise sliding trays 56 and 58 comprises at least one of a hydraulic, pneumatic, mechanically linked, electric, motorized, and electromagnetic mechanisms.

Turning back to FIG. 4, a pneumatic cylinder connects to a raising arm 74. As shown in FIG. 5A, a rear end of the trapdoor unit 46 is pivotally affixed to the device 40. In order to help align and square up objects on trays 56 and 58, moveable side walls 76 and 78 are positioned at left and right ends of the trays 56 and 58, and are moved inward and outwardly by mechanisms 80. The mechanisms are hydraulic, pneumatic, mechanically linked, electric, motorized, or electromagnetic mechanisms, and are activated by the control unit 50. The tamping unit 52 has tamping plates 82 which are sized to fit into the boxes 10, and are aligned above the open boxes 10A, 10B, and 10C. The tamping unit 52 preferably has a number of stations equal to the number of boxes to be loaded with objects. The box conveying unit 48 is designed to moves boxes from a first position (see FIG. 5A), where empty boxes 10A (10B and 10C not shown) are placed on a moveable platform 90, preferably with box alignment guides 92, and moves the boxes to a second position onto a trackway 94 under the trapdoor unit 46. The means to move the moveable platform can comprise a hydraulic, pneumatic, mechanically linked, electric, motorized, or electromagnetic mechanisms. Upon being moved to the second position (shown in FIG. 5B), a stopper 96 moves from a retracted position to an extended position (shown in FIG. 5C), thereby preventing the boxes from being moved away from the second position when the moveable platform 90 is returned to its first position shown in FIG. 5A for reloading with empty boxes. A sliding trackway or discharge conveyor 106 is adjacent to the trackway 94. A means to move the loaded boxes 10D, 10E, and 10F from the second position to the a third position on the discharge trackway 106 is provided, and can comprise a push plate 98 moved by hydraulic, pneumatic, mechanically linked, electric, motorized, or electromagnetic mechanisms. An alarm 110 is optionally provided in the device 40 to sound an audible sound and/or visible light to let a user know that the moveable platform 90 does not have empty boxes loaded thereon. The alarm 110 is activated by the control unit 50. A sensor 112 detects when the box conveying unit in the first position is not loaded with boxes, and can comprise an electric eye, pressure cells, proximity sensors, or other known sensing means. If there are no boxes readied for loading with objects, the sensor 112 will send a signal to halt operation of the boxing device 40 and the conveyor 42 and bag making machine until the empty boxes are again placed on the box conveying unit 48. In addition to the monitoring and sensor functions, the boxing device can be provided with video monitoring equipment so that a distant inspector can monitor the condition of the bags being loaded into the boxes, and even control the process, e.g. halt the machinery if there is a problem, or slow down and speed up the process if necessary. Empty boxes can be loaded onto the moveable platform 90 by hand, or can be loaded thereon by another mechanism (not shown.) In the embodiment of the invention shown, a plurality of columns of objects are packed into an equal number of plurality of boxes. To further align to objects onto the trapdoor trays 56 and 58, dividers 120 and 122 are provided. The trapdoors 56 and 58 are also adapted to be moved between a closed position, shown in FIG. 4, wherein the trapdoors 56 and 58 are close together, to an opened position, wherein the trays 56 and 58 are separated, as best shown in FIG. 6.

Figure 6:
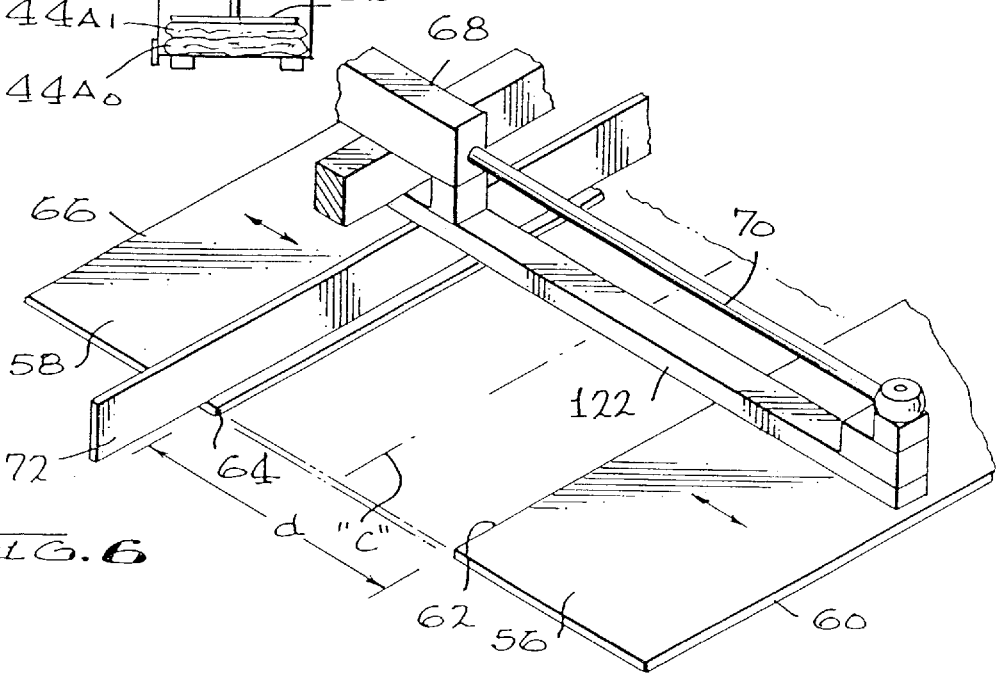
FIG. 6 is a top left perspective view showing the trays of the trapdoor unit in their opened position.

Turning to FIG. 6, the front tray 56 has a leading edge 60 and an inwardly facing edge 62. The rear tray 58 has an inwardly facing edge 64 and a trailing edge 66. In the position shown in FIG. 6, the inwardly facing edges 62 and 64 are separated by distance "d", and are moved apart in a co-planar manner by a separator unit 68. Distance "d" is greater than the length and/or width of the object 14, so that when the object is oriented on trays 56 and 58, it is received in a lay flat condition, but when trays 56 and 58 are separated, the object 14 may fall through without being twisted, folded, or otherwise deformed. Separator unit 68 is adapted to quickly, simultaneously, and slidably separate tray 56 from a centerline "C". This can be accomplished by attaching the tray 56 to a slide bar 70 which moves tray 56 from its closed position of FIG. 4 to its opened position of FIG. 6. A similar separator unit (not shown) moves trays 58 from its closed position of FIG. 4 to its opened position of FIG. 6. The separator units can be activated by hydraulic, pneumatic, electric, electromagnetic, and/or mechanical linked mechanisms. A retaining wall 72 is spaced above tray 58, so that when tray 58 is moved rearwardly and tray 56 moves forwardly, objects on tray 58 and 56 are prevented from shifting rearwardly, and drop through the opening "d", and are activated by the control unit 50. The trapdoor unit 46, the box conveying unit 48 and tamping unit 52 are controlled by the control unit 50, which also receives input from the conveyor 42, and provides precise timings to orchestrate the process.

Figure 7:
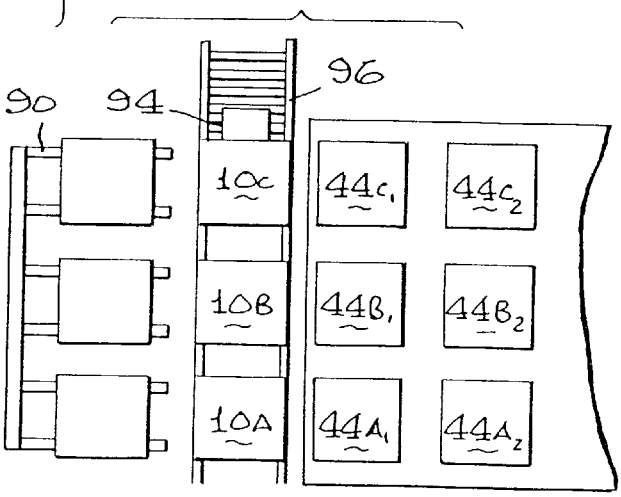
FIG. 7 is a simplified top plan view of the device showing empty boxes ready on box conveying unit.

Turning to FIG. 7, a simplified diagrammatic top plan view of the boxing device 40 is shown. Boxes 10A, 10B, and 10C are on the second position on the trackway 94, and another set of boxes 10G, 10H, and 10I are on the moveable platform 90 ready to be moved from its first position to the position of boxes 10A, 10B, and 10C after boxes 10A, 10B, and 10C are loaded with objects and moved to the discharge trackway 106.

The method of the invention will now be further explained with reference to FIGS. 5A–5E.

In FIG. 5A, which is a simplified right view of the boxing device 40 adjacent to a terminal end 130 of the conveyor 42. The forwardmost columns of objects 44$A_1$, 44$A_2$, and 44$A_3$ are shown on conveyor 42, and trays 56 and 58 are in their slanted up and closed position. In this position, the leading edge 60 of tray 56 is adjacent to terminal end 130. The tamping plate 82 of tamping unit 52 is in its upraised position. An empty box 10A is placed on the moveable platform 90. The stop 96 is in its unactivated position.

Figure 5B:
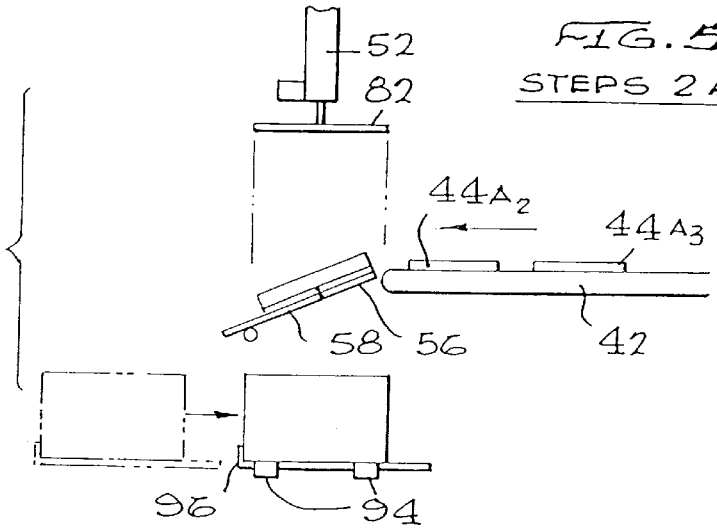
FIG. 5B is a side view illustrating operation of steps 2 and 3 of FIG. 2 of the operation of the boxing device.

In FIG. 5B, the conveyor 42 is moved so that object 44$A_1$, is moved off of the end 130 and slides onto trays 56 and 58. Either prior to or before this, box 10A would have been moved by moveable platform 90 to the second position under the trays 56 and 58 and onto track way 94.

Figure 5C:
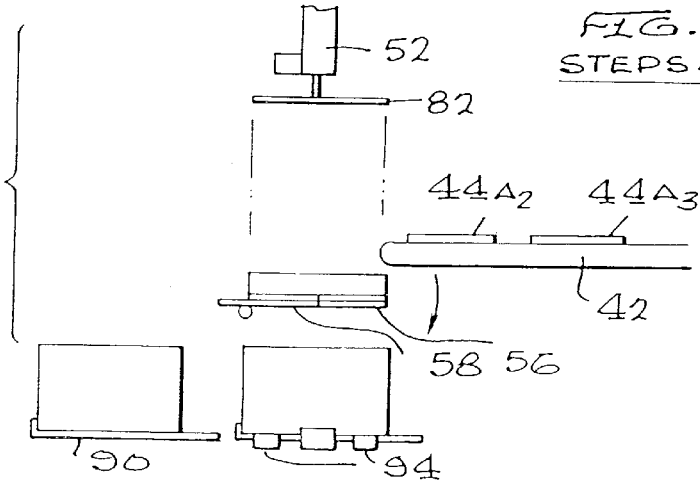
FIG. 5C is a is a side view illustrating operation of steps 4 and 5 of FIG. 2 of the operation of the boxing device.

Turning to FIG. 5C, trays 56 and 58 are moved to the horizontal position. Although not shown, in this horizontal position, the objects on the trays 56 and 58 will be suspended exactly above the opened boxes below. At this time, additional empty boxes can be loaded onto the moveable platform 90 of the box conveying means.

Figure 5D:
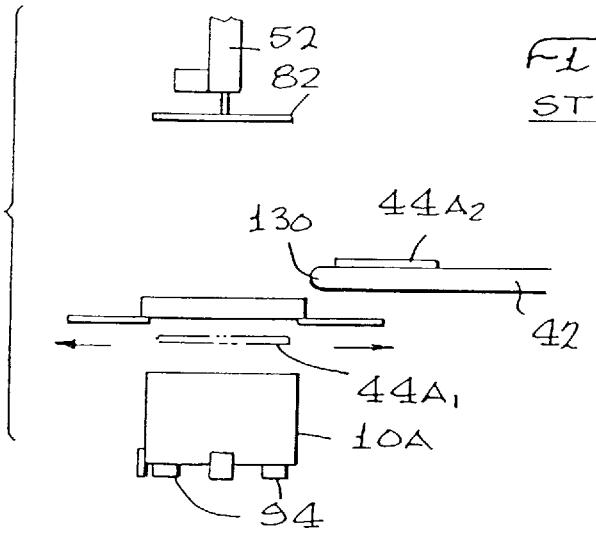
FIG. 5D is a side view illustrating operation of step 6 of FIG. 2 of the operation of the boxing device.

Turning to FIG. 5D, the trays 56 and 58 are rapidly and simultaneously separated. The object 44$A_1$ falls through the opening between the two trays 56 and 58, and into the open box 10A. Because the two trays are separated simultaneously, rapidly, and from the centerline, the object 44$A_1$ will not be deformed as its falls, and will fall into the open box 10A in a lay flat condition.

Figure 5E:
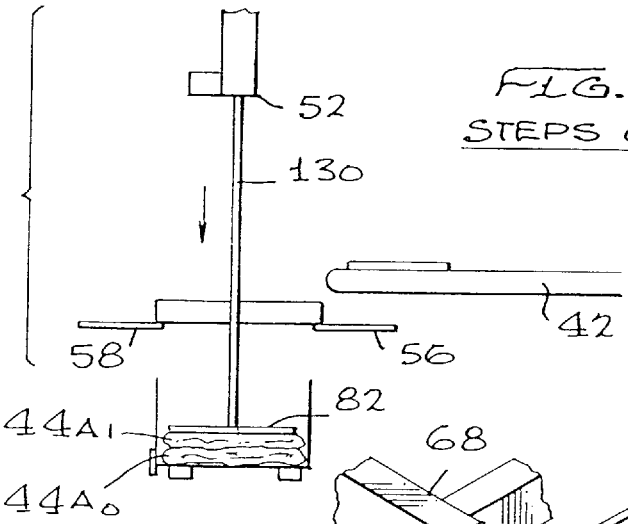
FIG. 5E is a is a side view illustrating operation of steps 8 and 9 of FIG. 2 of the operation of the boxing device.

FIG. 5E shows the tamping unit 52 being activated so that the tamping plate 82 passes through the open box 10A and tamps objects down into the box. The tamping plate 82 is connected with a driving shaft 130. In FIG. 5E, two objects 44$A_0$ and 44$A_1$ are shown stacked in the box 10A and being tamped. Depending upon the characteristics of the objects, it may not be necessary to tamp the objects into the box as each object falls into the box, and may be sufficient to tamp the objects every nth cycle. Obviously, the tamping plate 82 is sized to fit through the slid apart trays 56 an 58. After the objects are tamped into box 10A, the tamping plate 82 is retract back to its position shown in FIGS. 5A–5D.

Figure 8:
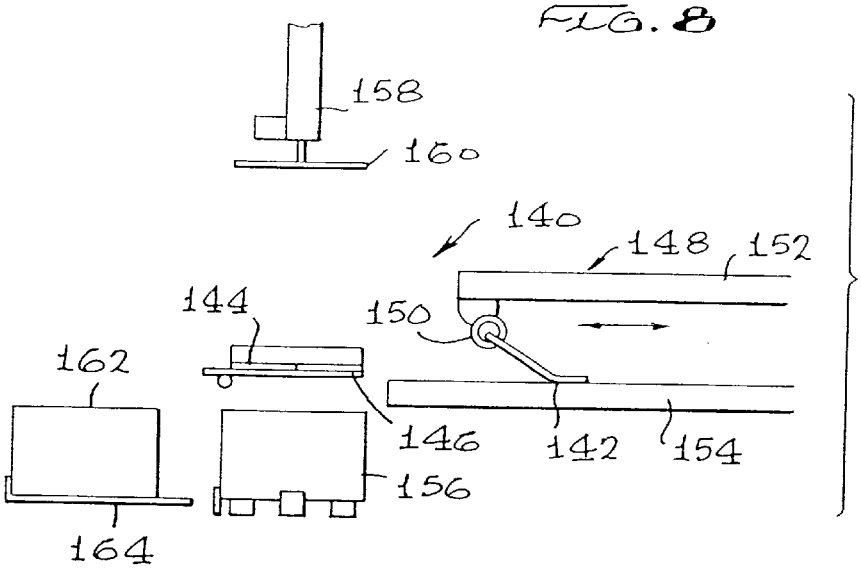
FIG. 8 is a side view of a second embodiment of a boxing device with an object being prepared to be loaded onto the sliding plates.
Figure 9:
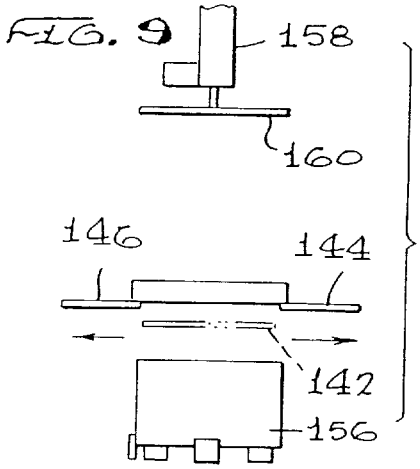
Figure 10:
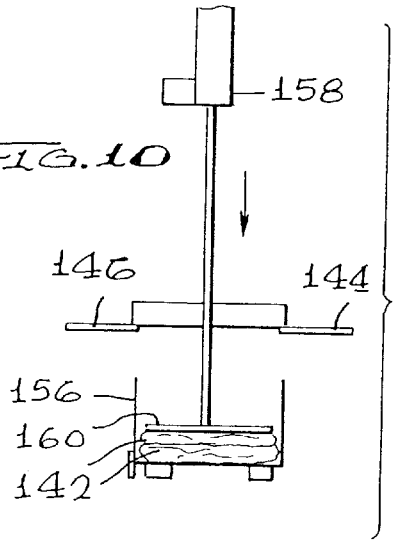
FIG. 10 is a side view of the boxing device of FIG. 8, with the tamping unit activated to tamp objects into the box.

Turning to FIGS. 8–10, there is shown a side view of a second embodiment of a boxing device 140. Boxing device 140 is a simplified version of the first embodiment of the boxing device 40, and does not include a slant adjustment feature. Instead, objects 142 are deposited onto co-planar sliding trays or plates 144 and 146 with the plates in a horizontal, or nearly horizontal position, with the plates 146 slide together. An object moving device 148 has a means 150 to move objects 142 onto the top surface of plates 144 and 146. This means 150 can comprise grips (as shown) moveable toward and away from the plates 144 and 146 by a track or rod 152, or other object moving means. The objects 142 being moved and be dragged along a n optional sliding surface 154. Once placed upon plates 144 and 146, if needed, the objects 142 can be aligned on the plates 144 and 146 as described above with respect to the first embodiment 40 to be situated directly above the open mouths of the boxes, cartons, or other containers 156. An optional tamper unit 158 with tamping plates or means 160 is positioned above the plates 144 and 146.

Turning to FIG. 9, after the objects 142 are placed on the plates 144 and 146, the plates are slide apart in a co-planar manner by a distance sufficient to allow the objects 142 to drop straight through the opening and into the box, carton, or container 146 below.

FIG. 10 is a side view showing objects 142 being tamped into the boxes 156 by the tamping plate 160 of the tamping unit 158. Depending upon the characteristics and numbers of objects 142 to be placed into the boxes, tamping may need not take place each time objects are dropped into the boxes 156. Empty boxes can be moved from a staging position 162 to a position under the sliding plates by a box conveying unit 164 (see FIG. 8) as described above with respect to the first embodiment of the device, and after loaded with objects, the boxes 156 can be ejected from underneath the sliding plates to a third position, also as described above.

Figure 11:
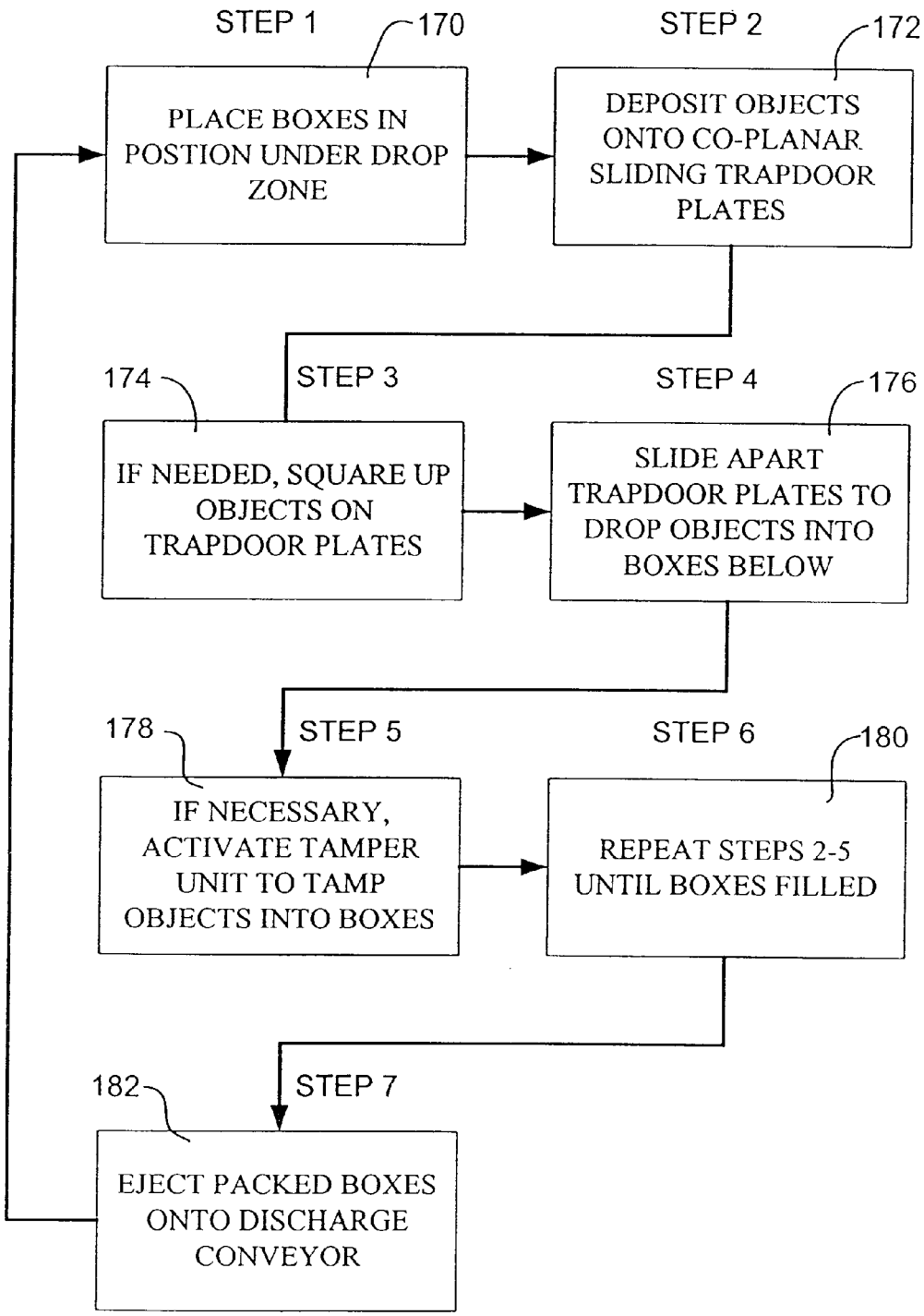
FIG. 11 is a flowchart illustrating the steps undertaken by an another embodiment of the device to load a plurality of objects into a box.

Turning to FIG. 11, there is shown a flowchart showing the steps undertaken by an alternate embodiment of the invention to load objects into boxes, cartons, or other containers. In step 1 (170), a box, carton, or other container is placed under a drop zone. In step 2 (172), objects are deposited onto trapdoor plates of the device. In step 3 (174), objects are squared up on the trapdoor plates if needed. In step 4 (176), the trapdoor plates are slide apart to drop objects into the boxes below. In step 5 (178), if necessary, the tamper unit is activated to tamp objects into the boxes. In step 6 (180), steps 2–5 are repeated until the boxes are filled with objects. In step 7 (182), the packed boxes are ejected on a discharge conveyor, and the cycle can begin again.

The trays or plates 56 and 58 and 144 and 146 of the embodiments 40 and 140, respectively, can be provided in a variety of materials, such as metal, plastics, fiberboard, fiberglass that provide a low friction surface upon which the object are deposited. The plates 56 and 58 and 144 and 146 can be coated with Teflon or other low friction material, and the plates can be flat (as shown) or can alternately have a shape that designed to reduce the area of contact between the objects and the plates.

Figure 12A:
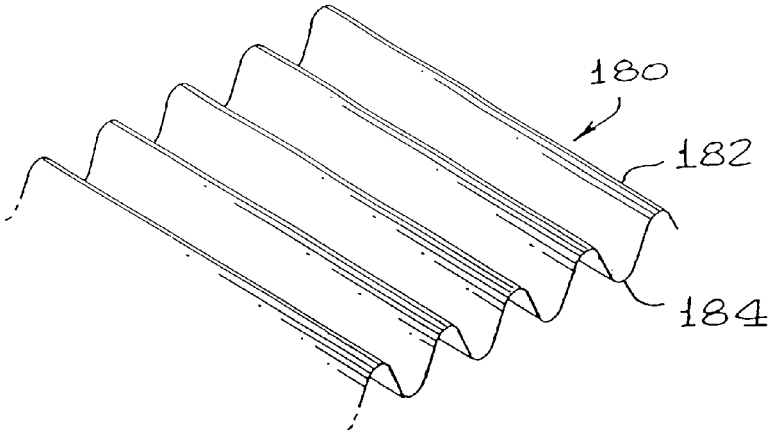
FIG. 12A is an isometric view of a trapdoor tray with a wavy surface.
Figure 12B:
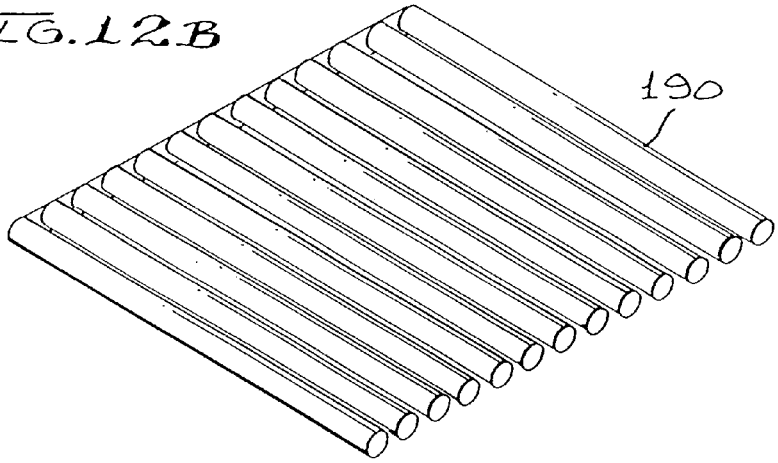
FIG. 12B is an isometric view of a trapdoor tray formed from rods.
Figure 12C:
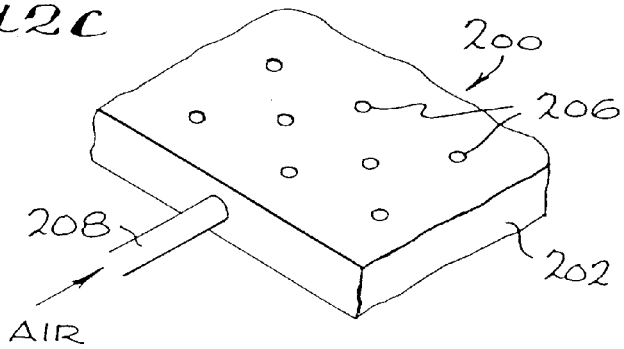
FIG. 12C is an isometric view of a trapdoor tray having an air suspension feature.

Turning to FIGS. 12A–12C, the embodiments of the device can be outfitted with shapes and features designed so that the objects can more easily slide on the trays when the trays are slide apart. Referring to FIG. 12A, the trays can optionally have a waved shape 180 with ridges 182 and valleys 184, so that the objects rest on the ridges 182 and can more easily slide off the trays. Referring to FIG. 12B, the trays can also comprise parallel rods 190, or a mesh (not shown.)

Turning to FIG. 12C, the trays 200 can also be designed to provide an air suspension of objects placed thereon. This can be accomplished by provided trays 200 with a sandwiches construction, with a solid lower sheet 202 and an upper sheet 204 with a plurality of air holes 206. Pressurized air 208 will be supplied to the trays 200 and the pressurized air will pass through the air holes 206 to provide for air suspension of the objects on the trays. While a limited number of embodiments has been described, they are all friction decreasing features for the trays or plates, and the trays or plates can be provided with other friction decreases features, and the invention is not limited to the above described embodiments.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation.

What is claimed is:

1. A device for use in packaging objects having a length and width into boxes and for use in combination with a conveyor device upon which the objects to be boxed are placed, the conveyor device having a terminal end, the boxing device being placed adjacent to the terminal end of the conveying device, the boxing device comprising:

a trapdoor unit having at least two co-planar trays each having inside facing edges, the trapdoor unit having a front and a rear, the at least two trays being adapted to move between a closed position wherein the facing edges are in close contact with each other, and an opened position wherein the trays remain co-planar with the facing edges of the two trays separated from each other by a distance, the at least two trays being adapted to be rapidly and simultaneously moved apart from the closed position to the opened position in a sliding manner, and the trapdoor further being moveable between a first orientation wherein the two trays are on a plane that is slanted downwardly from the front to the rear, and a second orientation wherein the two trays are generally horizontal;

a box conveying unit having a means to move boxes from a first position spaced away from underneath the trays of the trapdoor unit to a second position that is aligned below the horizontally positioned trays of the trapdoor unit; and a control unit that controls the operation of the trapdoor unit and the box conveying unit.

2. The boxing device of claim 1, further comprises a tamping unit with a tamping plate adapted to be moved from a raised position to a lowered position to tamp objects into the box.

3. The boxing device of claim 1, wherein in the closed position, the two trays of the trapdoor unit are sized to hold the object, and in opened position, the distance between the facing edges is sufficiently large to allow the object to fall therethrough.

4. The boxing device of claim 3, wherein the distance between the facing edges when the trays are in the opened position is greater than at least one or both of the length and the width of the object.

5. The boxing device of claim 1, wherein the trays are moved between the closed and opened position and between the first and second orientation by at least one of a hydraulic, pneumatic, mechanically linked, electric, motorized, and electromagnetic mechanisms.

6. The boxing device of claim 1, wherein the means to move empty, open boxes from a first position to the second position comprises at least one of a hydraulic, pneumatic, mechanically linked, electric, motorized and electromagnetic mechanisms.

7. The boxing device of claim 1, wherein the trapdoor unit further comprises a retaining wall on its rear region spaced above the trays, and moveable side walls perpendicular to the retaining wall.

8. The boxing device of claim 7, wherein the retaining wall remains stationary when the trays are moved between the opened and closed position.

9. The boxing device of claim 7, wherein the moveable side walls move inwardly to align objects deposited on the trays with an opening of the box positioned therebelow.

10. The boxing device of claim 1, wherein the box conveying unit further includes a means to move the box loaded with objects from the second position, to a third position distant the second position.

11. The boxing device of claim 10, wherein the third position comprises a sliding track way.

12. The boxing device of claim 1, wherein the means to move the empty open box from the first position to the second position comprises a moveable platform that pushes the open box onto a track.

13. The boxing device of claim 12, wherein the box conveying unit further comprises a stopper which holds the box in the second position.

14. The boxing device of claim 12, wherein the moveable platform includes box guides for placement of empty boxes, and wherein after the boxes are moved to the second position, the moveable platform is returned to the first position for reloading with empty boxes.

15. The boxing device of claim 1, wherein a plurality of columns of objects are deposited onto the conveyor device and an equal plurality of boxes are positioned under the trays of the trapdoor unit.

16. The boxing device of claim 15, wherein the trapdoor unit further comprises a retaining wall on its rear region spaced above the trays, moveable side walls perpendicular to the retaining wall, and at least one divider above the co-planar trays, wherein the retaining wall and spaced above the trays, the moveable side walls, and at least one divider are provided to align the plurality of objects onto the trays of the trapdoor unit,precisely above the open boxes positioned therebelow.

17. The boxing device of claim 1, wherein the control unit includes a sensor that detects whenever the box conveying unit in the first position is not loaded with a box.

18. The boxing device of claim 17, further comprising at least one of an audible alarm and a light alarm that are activated when the box conveying unit is not loaded with boxes.

19. The boxing device of claim 18, wherein the sensor will send a signal to halt operation of the boxing device until the box conveying unit is reloaded with boxes.

20. The boxing device of claim 17, wherein the box conveying unit is manually loaded with empty boxes by a user at its first position.

21. The device of claim 1, wherein the co-planar trays have friction reducing means.

22. The device of claim 21, wherein the friction reducing means comprises at least one of the trays being formed of a low friction material, the trays having a non-flat surface to reduce the area of contact between the objects and the trays, and the trays having an air suspension means.

23. A device for use in boxing pliable objects having a footprint area into boxes and for use in combination with a conveyor upon which the pliable objects to be boxed are moved off of a terminal end thereof, the boxing device being loaded adjacent to the terminal end of the conveyor and adapted to receive objects moving off of the terminal end, the boxing device comprising:

a trapdoor unit having sliding trays each having a length and a width and inside facing edges, the trapdoor unit having a front and a rear, the trapdoor being moveable between a first orientation wherein the trays are slanted downwardly from the front to the rear, and a second orientation wherein the trays are generally horizontal, the sliding trays further being adapted to move between a closed position wherein the facing edges are in proximity with each other, and an opened position wherein the trays are slid apart with the facing edges of the two trays separated from each other by a distance sufficiently large to pass the footprint area of the object;

a box conveying unit having a means to move boxes from a first position spaced away from underneath the trays of the trapdoor unit to a second position that is aligned below the horizontally positioned trays, of the trapdoor unit and to a third position distant the second position; and a control unit that controls the operation of trapdoor unit and the box conveying unit.

24. The boxing device of claim 23, further comprises a tamping unit with a tamping plate adapted to be moved from a raised position above the box to a lower position to tamp the objects into the box.

25. The boxing device of claim 23, wherein the sliding trays are adapted to be rapidly and simultaneously moved apart from the closed position to the opened position.

26. The boxing device of claim 23, wherein the trays are moved between the closed and opened position and between the first and second orientation by at least one of a hydraulic, pneumatic, mechanically linked, electric, motorized, and electromagnetic mechanisms.

27. The boxing device of claim 23, wherein the means to move empty, open boxes from a first position to the second position comprises at least one of a hydraulic, pneumatic, mechanically linked, electric, motorized and electromagnetic mechanisms.

28. The boxing device of claim 23, wherein the trapdoor unit further comprises a retaining wall on its rear region spaced above the trays and moveable side walls that move inwardly to align objects deposited on the trays with an opening of the box positioned therebelow.

29. The boxing device of claim 23, wherein the box conveying unit further includes a means to move the box loaded with objects from the second position, to a third position distant the second position.

30. The boxing device of claim 29, wherein the third position comprises a sliding track way.

31. The boxing device of claim 23, wherein the means to move the boxes from the first position to the second position comprises a moveable platform that pushes the boxes onto a track under the trays of the trapdoor unit.

32. The boxing device of claim 31, wherein the moveable platform includes box guides for placement of empty boxes, and wherein after the boxes are moved to the second position, the moveable platform is returned to the first position for reloading with empty boxes.

33. The boxing device of claim 23, wherein the box conveying unit further comprises a stopper which hold the boxes in the second position.

34. The boxing device of claim 23, wherein a plurality of columns of objects are deposited onto the conveyor and an equal plurality of boxes are positioned under the trays of the trapdoor unit.

35. The boxing device of claim 34, wherein the trapdoor unit further comprises a retaining wall on its rear region spaced above the trays, moveable side walls perpendicular to the retaining wall and spaced above the trays, and at least one divider above the co-planar trays, wherein the retaining wall, the moveable side walls, and the at least one divider align the plurality of objects onto the trays of the trapdoor unit precisely above the open boxes positioned therebelow.

36. The boxing device of claim 23, wherein the control unit includes a sensor that detects whenever the box conveying unit in the first position is not loaded with boxes.

37. The boxing device of claim 36, further comprising at least one of an audible alarm and light alarm that is activated when the box conveying unit is empty.

38. The boxing device of claim 36, wherein the sensor will send a signal to halt operation of the boxing device until the box conveying unit is loaded with boxes.

39. The device of claim 23, wherein the co-planar sliding trays have friction reducing means.

40. The device of claim 39, wherein the friction reducing means comprises at least one of the trays being formed of a low friction material, the trays having a non-flat surface to reduce the area of contact between the objects and the trays, and the trays having an air suspension means.

41. A device for use in boxing a plurality of columns of pliable objects having a footprint area into an equal plurality of boxes and for use in combination with a conveyor upon which the plurality of columns of pliable objects to be boxed are moved off of a terminal end thereof, the boxing device being located adjacent to the terminal end of the conveyor and adapted to receive the plurality of columns of pliable objects moving off of the terminal end, the boxing device comprising:

a trapdoor unit having sliding trays each having a length and a width and inside facing edges, the trapdoor unit having a front region and a rear region, a retaining wall on its rear region spaced above the trays, moveable side walls perpendicular to the retaining wall and spaced above the trays, and at least one divider above the co-planar trays, wherein the retaining wall, the moveable side walls, and the at least one divider align the plurality of objects onto the trays of the trapdoor unit precisely above the open boxes positioned therebelow, and wherein the trapdoor are moveable between a first orientation wherein the trays are slanted downwardly from the front to the rear, and a second orientation wherein the trays are generally horizontal, the sliding trays further being adapted to be rapidly and simultaneously moved apart from a closed position, wherein the facing edges are in proximity with each other and adapted to receive the plurality of objects thereon, to an opened position, wherein the trays are slid apart with the facing edges of the two trays separated from each other by a distance sufficiently large to pass the footprint areas of the plurality of objects;

a box conveying unit having a means to move an equal plurality of empty, open boxes from a first position spaced away from underneath the trays of the trapdoor unit to a second position wherein the boxes are aligned below the horizontally positioned trays of the trapdoor unit, and to a third position distance the second position;

a tamping unit with a tamping plate adapted to be moved from a raised position above the box to a lower position to tamp the objects into the box; and a control unit that controls the operation of trapdoor unit, the box conveying unit, and the tramping unit.

42. The boxing device of claim 41, wherein the sliding trays are moved between the closed and opened position and between the first and second orientation by at least one of a hydraulic, pneumatic, mechanically linked, electric, motorized, and electromagnetic mechanisms.

43. The boxing device of claim 41, wherein the means to move empty, open boxes from the first position to the second position comprises at least one of a hydraulic, pneumatic, mechanically linked, electric, motorized and electromagnetic mechanisms.

44. She boxing device of claim 41, wherein the third position comprises a sliding track way.

45. The boxing device of claim 41, wherein the means to move the boxes from the first position to the second position comprises a moveable platform that pushes the boxes onto a track under the trays of the trapdoor unit.

46. The boxing device of claim 45, wherein the moveable platform includes box guides for placement of empty boxes, and wherein after the boxes are moved to the second position, the moveable platform is returned to the first position for reloading with empty boxes.

47. The boxing device of claim 41, wherein the box conveying unit further comprises a stopper which hold the boxes in the second position until they are moved to the third position.

48. The boxing device of claim 41, wherein the control unit includes a sensor that detects whenever the box conveying unit in the first position is not loaded with boxes.

49. The boxing device of claim 48, further comprising at least one of an audible alarm and light alarm that is activated when the box conveying unit is empty, and will send a signal to halt operation of the boxing device until the box conveying unit is loaded with boxes.

50. The device of claim 41, wherein the co-planar trays have friction reducing means.

51. A device for use in packaging objects having a length and width into boxes and for use in combination with a conveyor device upon which the objects to be boxed are placed, the conveyor device having a terminal end, the boxing device being placed adjacent to the terminal end of the conveying device, the boxing device comprising:

a trapdoor unit having at least two co-planar trays each having inside facing edges, the trapdoor unit having a front and a rear, the at least two trays being adapted to move between a closed position wherein the facing edges are in close contact with each other, and an opened position wherein the trays remain co-planar with the facing edges of the two trays separated from each other by a distance, the trapdoor further being moveable between a first orientation wherein the two trays are on a plane that is slanted downwardly from the front to the rear, and a second orientation wherein the two trays are generally horizontal;

a box conveying unit having a means to move boxes from a first position spaced away from underneath the trays of the trapdoor unit to a second position that is aligned below the horizontally positioned trays of the trapdoor unit; and a control unit that controls the operation of the trapdoor unit and the box conveying unit and includes a sensor that detects whenever the box conveying unit n the first position is not loaded with a box.

52. A device for use in packaging objects having a length and width into boxes and for use in combination with a conveyor device upon which the objects to be boxed are placed, the conveyor device having a terminal end, the boxing device being placed adjacent to the terminal end of the conveying device, the boxing device comprising:

a trapdoor unit having at least two co-planar trays each having inside facing edges, the trapdoor unit having a front and a rear, the at least two trays being adapted to move between a closed position wherein the facing edges are in close contact with each other, and an opened position wherein the trays remain co-planar with the facing edges of the two trays separated from each other by a distance, the trapdoor further being moveable between a first orientation wherein the two trays are on a plane that is slanted downwardly from the front to the rear, and a second orientation wherein the two trays are generally horizontal;

a box conveying unit having a means to move boxes from a first position spaced away from underneath the trays of the trapdoor unit to a second position that is aligned below the horizontally positioned trays of the trapdoor unit, wherein the box conveying unit is manually loaded with; and a control unit that controls the operation of the trapdoor unit and the box conveying unit.

53. A device for use in packaging objects having a length and width into boxes and for use in combination with a conveyor device upon which the objects to be boxed are placed, the conveyor device having a terminal end, the boxing device being placed adjacent to the terminal end of the conveying device, the boxing device comprising:

a trapdoor unit having at east two co-planar trays each having inside facing edges, the trapdoor unit having a front and a rear, the at least two trays being adapted to move between a closed position wherein the facing edges are in close contact with each other, and an opened position wherein the trays remain co-planar with the facing edges of the two trays separated from each other by a distance, the trapdoor further being moveable between a first orientation wherein the two trays are on a plane that is slanted downwardly from the front to the rear, and a second orientation wherein the two trays are generally horizontal;

a box conveying unit having a means to move boxes from a first position spaced away from underneath the trays of the trapdoor unit to a second position that s aligned below the horizontally positioned trays of the trapdoor unit, and a means to move the box loaded with objects from the second position, to a third position comprising a sliding track way distant the second position; and a control unit that controls the operation of the trapdoor unit and the box conveying unit.

54. A device for use in packaging objects having a length and width into boxes and for use in combination with a conveyor device upon which the objects to be boxed are placed, the conveyor device having a terminal end, the boxing device being placed adjacent to the terminal end of the conveying device, the boxing device comprising:

a trapdoor unit having at least two co-planar trays each having inside facing edges, the trapdoor unit having a front and a rear, the at least two trays being adapted to move between a closed position wherein the facing edges are in close contact:with each other, and an opened posit on wherein the trays remain co-planar with the facing edges of the two trays separated from each other by a distance, the trapdoor further being moveable between a first orientation wherein the two trays are on a plane that is slanted downwardly from the front to the rear, and a second orientation wherein the two trays are generally horizontal;

a box conveying unit having a moveable platform, including box guides for placement of empty boxes, the moveable platform moving boxes from a first position spaced away from underneath the trays of the trapdoor unit to a second position comprising a track that is aligned below the horizontally positioned trays of the trapdoor unit, the moveable platform thereafter being returned to the first position for reloading with empty boxes; and a control unit that controls the operation of the trapdoor unit and the box conveying unit.

55. A device for use in packaging objects having a length and width into boxes and for use in combination with a conveyor device upon which the objects to be boxed are placed, the conveyor device having a terminal end, the boxing device being placed adjacent to the terminal end of the conveying device, the boxing device comprising:

a trapdoor unit having at least two co-planar trays with friction reducing means, each tray having inside facing edges, the trapdoor unit having a front and a rear, the at least two trays being adapted to move between a closed position wherein the acing edges are in close contact with each other, and an opened position wherein the trays remain co-planar with the facing edges of the two trays separated from each other by a distance, the trapdoor further being moveable between a first orientation wherein the two trays are on a plane that is slanted downwardly from the front to the rear, and a second orientation wherein the two trays are generally horizontal;

a box conveying unit having a means to move boxes from a first position spaced away from underneath the trays of the trapdoor unit to a second position that is aligned below the horizontally positioned trays of the trapdoor unit; and a control unit that controls the operation of the trapdoor unit and the box conveying unit.

56. The device of claim 55, wherein the friction reducing means comprises at least one of the trays being formed of a low friction material, the trays having a non-flat surface to reduce the area of contact between the objects and the trays, and the trays having an air suspension means.

57. A device for use in packaging objects into boxes, comprising:

a trapdoor unit having at least two co-planar trays, the at least two trays being adapted to move between a closed position wherein the two co-planar trays are close to each other to support an object deposited thereon, and an opened position wherein the at least two trays remain co-planar but are separated from each other by a distance sized to allow the object to pass therethrough, the at least two trays being adapted to be rapidly and simultaneously moved apart from the closed position to the opened position in a sliding manner to allow objects deposited on the two trays to drop therethrough; and a box conveying unit having a means to move boxes from a first position spaced away from underneath the trays of the trapdoor unit to a second position that is aligned below the horizontally positioned trays of the trapdoor unit.

58. The device of claim 57, wherein the trapdoor unit is further moveable between a first orientation wherein the two trays are on a slanted plane, and a second orientation wherein the two trays are on a generally horizontal plane.

59. The device of claim 57, wherein the two trays remain in a generally horizontal position when in the closed and opened positions.

60. The device of claim 57, wherein the device further comprises means to align objects on the co-planar trays.

61. The device of claim 60, wherein the means to align objects on the co-planar plates comprise width adjusting walls and a stop wall.

62. The device of claim 57, further comprising a box conveying unit having a means to move boxes from a first position spaced away from underneath the trays of the trapdoor unit to a second position that is aligned below the trays of the trapdoor unit.

63. The device of claim 57, further comprising a control unit that controls the operation of the trapdoor unit and the box conveying unit.

64. The device of claim 57, further comprises a tamping unit with a tamping plate adapted to be moved from a raised position to a lowered position to tamp objects into the box.

* * * * *

UNITED STATES PATENT AND TRADEMARK OFFICE

CERTIFICATE OF CORRECTION

PATENT NO. : 6,438,928 B1
DATED : August 27, 2002
INVENTOR(S) : Huang et al.

It is certified that error appears in the above-identified patent and that said Letters Patent is hereby corrected as shown below:

Title page,
Item [73], Assignee, replace "Supertonics" with -- Supertronics --.

Column 8,
Line 42, replace "18" with -- 17 --.
Line 45, replace "17" with -- 1 --.

Signed and Sealed this

Fourteenth Day of September, 2004

JON W. DUDAS
*Director of the United States Patent and Trademark Office*